US011118250B2

(12) United States Patent
Mizuno et al.

(10) Patent No.: US 11,118,250 B2
(45) Date of Patent: Sep. 14, 2021

(54) FE—CR—NI ALLOY AND METHOD FOR PRODUCTION THEREOF

(71) Applicant: Nippon Yakin Kogyo Co., Ltd., Tokyo (JP)

(72) Inventors: Kenji Mizuno, Kawasaki (JP); Hidekazu Todoroki, Kawasaki (JP); Yosuke Baba, Kawasaki (JP); Yusuke Kobayashi, Kawasaki (JP); Waki Nishijima, Kawasaki (JP)

(73) Assignee: NIPPON YAKIN KOGYO CO., LTD., Tokyo (JP)

( * ) Notice: Subject to any disclaimer, the term of this patent is extended or adjusted under 35 U.S.C. 154(b) by 237 days.

(21) Appl. No.: 16/335,042

(22) PCT Filed: Jun. 21, 2017

(86) PCT No.: PCT/JP2017/022888

§ 371 (c)(1),
(2) Date: Mar. 20, 2019

(87) PCT Pub. No.: WO2018/066182

PCT Pub. Date: Apr. 12, 2018

(65) Prior Publication Data

US 2020/0347488 A1 Nov. 5, 2020

(30) Foreign Application Priority Data

Oct. 4, 2016 (JP) ..... JP2016-196722

(51) Int. Cl.

| | |
|---|---|
| ***C22C 38/50*** | (2006.01) |
| ***C21C 5/54*** | (2006.01) |
| ***C21C 7/06*** | (2006.01) |
| ***C21C 7/064*** | (2006.01) |
| ***C21C 7/068*** | (2006.01) |
| ***C21C 7/076*** | (2006.01) |
| ***C21C 7/10*** | (2006.01) |
| ***C22C 1/02*** | (2006.01) |
| ***C22C 30/00*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/44*** | (2006.01) |

(52) U.S. Cl.

CPC ..... *C22C 38/50* (2013.01); *C21C 5/54* (2013.01); *C21C 7/06* (2013.01); *C21C 7/064* (2013.01); *C21C 7/068* (2013.01); *C21C 7/076* (2013.01); *C21C 7/10* (2013.01); *C22C 1/02* (2013.01); *C22C 30/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/44* (2013.01)

(58) Field of Classification Search

None

See application file for complete search history.

(56) References Cited

U.S. PATENT DOCUMENTS

| | | | |
|---|---|---|---|
| 4,742,324 | A | 5/1988 | Shida et al. |
| 4,808,371 | A | 2/1989 | Taniuchi et al. |
| 9,777,356 | B2 | 10/2017 | Yamakawa et al. |

FOREIGN PATENT DOCUMENTS

| | | | | |
|---|---|---|---|---|
| JP | S63-121641 | A | | 5/1988 |
| JP | S64-008695 | B2 | | 2/1989 |
| JP | S64-011106 | B2 | | 2/1989 |
| JP | 07003368 | A | * | 1/1995 |
| JP | 2000239740 | A | * | 9/2000 |
| JP | 2003-147492 | A | | 5/2003 |
| JP | 2008-266706 | A | | 11/2008 |
| JP | 2013-241650 | A | | 12/2013 |
| JP | 2014-084493 | A | | 5/2014 |
| JP | 2014-189826 | A | | 10/2014 |
| JP | 2016-094662 | A | | 5/2016 |

OTHER PUBLICATIONS

English language machine translation of JP-2000239740-A to Urayama. Generated Jan. 7, 2020. (Year: 2020).*

"Steel Melt Processing." ASM Handbook, vol. 15 Casting. pp. 206-229. 2008. (Year: 2008).*

English language machine translation of JP 07003368 to Miyata et al. Generated May 28, 2021. (Year: 2021).*

(Continued)

*Primary Examiner* — Brian D Walck

(74) *Attorney, Agent, or Firm* — Oliff PLC

(57) ABSTRACT

Ti, N, Al, Mg, and Ca concentrations are controlled in order to prevent aggregation of TiN inclusions. Furthermore, not only is a Fe—Cr—Ni alloy having superior surface property provided, but also a method is proposed in which the Fe—Cr—Ni alloy is produced at low cost using commonly used equipment. The Fe—Cr—Ni alloy includes C≤0.05%, Si: 0.1 to 0.8%, Mn: 0.2 to 0.8%, P≤0.03%, S≤0.001%, Ni:16 to 35%, Cr: 18 to 25%, Al: 0.2 to 0.4%, Ti: 0.25 to 0.4%, N≤0.016%, Mg: 0.0015 to 0.008%, Ca≤0.005%, O: 0.0002 to 0.005%, freely selected Mo: 0.5 to 2.5% in mass % and Fe and inevitable impurities as the remainder, wherein Ti and N satisfy % N×% Ti≤0.0045 and the number of TiN inclusions not smaller than 5 μm is 20 to 200 pieces/$cm^2$ at a freely selected cross section.

7 Claims, No Drawings

(56) References Cited

OTHER PUBLICATIONS

Nippon Yakin Kogyo Co., Ltd., Seihin Catalog (NAS H840), Nippon Yakin Kogyo Co., Ltd. [online], May 19, 2015, <URL: <http://www.nyk.co.jp/pdf/procucts/alloys/NAS_H840_J.pdf>>.
Aug. 15, 2017 Search Report issued in International Patent Application No. PCT/JP2017/022888.
Aug. 13, 2018 International Preliminary Report on Patentability issued in International Patent Application No. PCT/JP2017/022888.

* cited by examiner

FE—CR—NI ALLOY AND METHOD FOR PRODUCTION THEREOF

TECHNICAL FIELD

The present invention relates to Fe—Cr—Ni alloys having superior surface quality, and in particular, relates to Fe—Cr—Ni alloys having superior high temperature corrosion resistance in high temperature air environments, superior corrosion resistance in wet conditions such as in water, and superior properties in blackening treatment, which is used for cladding tubes of a so-called "sheathed heater".

BACKGROUND ART

Fe—Cr—Ni alloys such as stainless steel have superior corrosion resistance, heat resistance, and workablity. In most cases, the alloy is used as it is in a condition in which the alloy surface is not treated by coating or the like because of its superior corrosion resistance. Therefore, high quality of the surfaces of Fe—Cr—Ni alloys is required.

Furthermore, due to its superior heat resistance, Fe—Cr—Ni alloys are often used as furnace material or the like. Furthermore, Fe—Cr—Ni alloys are often used as a mantle material of sheathed heaters. This sheathed heater is used as a heat source for an electric cooker, electric water heater, and the like. In the structure of this heater, a nichrome wire is inserted in a metallic cladding tube, magnesia powder or the like is filled in a space, and the tube is completely sealed. Heating is performed by supplying current through the nichrome wire.

This heating method is very safe since there is no flame, and it has been widely used in electric cookers such as fish grills, and in electric water heaters as essential equipment in a so-called "all-electric home". The demand therefor has been rapidly spreading in recent years (For example, see Patent Documents 1 to 5 below).

However, in an Fe—Cr—Ni alloy which contains Ti and Al, which are necessary for a sheathed heater, TiN inclusions may be generated due to the presence of Ti, and surface defects may occur. On the other hand, a technique is disclosed in which generation of TiN inclusions is reduced by decreasing Si concentration. However, depending on non-metallic inclusion oxide composition, there may be risk of the occurrence of defects, and the effect may not be sufficient (For example, see Patent document 6).

Furthermore, a technique for production of Fe—Cr—Ni type alloys having superior surface properties is disclosed. This technique is to prevent surface defects by avoiding $MgO.Al_2O_3$ (spinel type) and CaO inclusions. This technique controls all of the inclusions to be $CaO—TiO_2—Al_2O_3$ type inclusions. However, depending on fine differences in operation, the inclusions may be mainly $TiO_2$, and damage may occur. In particular, since surface quality of the sheathed heater is strictly required, it is impossible to use this technique. Furthermore, there is a risk that slag will not melt or flowability will be too high so as to melt and damage refractory bricks lining the refining furnace because the F concentration in the slag is not known. In such a case in which the F concentration is not appropriate, there is a problem that the inclusion composition may become mainly a single phase of CaO and MgO, and the inclusions are difficult to control (For example, see Patent document 7).

The Patent documents are as follows.

Patent document 1: Japanese Examined Patent Application Publication No. Showa 64 (1989)-008695

Patent document 2: Japanese Examined Patent Application Publication No. Showa 64 (1989)-011106

Patent document 3: Japanese Examined Patent Application Publication No. Showa 63 (1988)-121641

Patent document 4: Japanese Unexamined Patent Application Publication No. 2013-241650

Patent document 5: Japanese Unexamined Patent Application Publication No. 2014-84493

Patent document 6: Japanese Unexamined Patent Application Publication No. 2003-147492

Patent document 7: Japanese Unexamined Patent Application Publication No. 2014-189826

SUMMARY OF THE INVENTION

An object of the present invention is to control concentrations of Ti, N, Al, Mg and Ca so as to prevent aggregations of TiN inclusions being generated. In addition, another object is to provide Fe—Cr—Ni alloys having superior surface properties and to suggest methods of production of Fe—Cr—Ni alloys by using a commonly used apparatus which is low in cost.

The inventors have researched to solve the above-mentioned problems. First, they collected surface defect parts observed on a surface of a cold-rolled plate produced by a real apparatus and researched the actual causes of the defects. There were some defects of large size extending several meters. As a result, many TiN inclusions, MgO inclusions, and CaO inclusions were detected in the defects, and it was obvious that they were of concern in generating defects. Furthermore, as a result of observing forms of the inclusion in the surface defects in detail, they found that TiN inclusions were present accompanied by MgO inclusions and CaO inclusions.

Since the defects were never generated under conditions in which the above inclusions exist only in unaggregated form, the inventors researched about the sites at which inclusions aggregated and grew in size. When they collected melted alloy in a ladle and observed it, no clustered inclusions of large size were detected. In particular, almost no TiN inclusions were observed. Next, when they produced a slab by a continuous casting apparatus, cut it, and observed the inside thereof, it was observed that TiN inclusions had formed. From these results, it was obvious that formation of TiN inclusions tend to increase as temperature decreases.

Next, they collected an immersed nozzle for pouring melted metal from a tundish of the continuous casting apparatus to a mold. Carefully observing, adhered material mainly comprised bare metal and having a thickness of 5 to 10 mm was present. Inside thereof, clusters of TiN inclusions were observed all over the surface. Observing further, it was obvious that TiN inclusions were generated on MgO and CaO inclusions. That is, it was obvious that MgO and CaO inclusions function as cores so as to aid in the formation of TiN inclusions, and thus, they promoted the formation of TiN inclusions. TiN is known for its effects in promoting solidification of alloys, and it is thought that bare metal grows by TiN.

Continuing further research, they collected immersed nozzles after casting which had been used in each charge. It was obvious that even if there were few MgO and CaO inclusions, spontaneous formation reaction of TiN was promoted, TiN inclusions were formed, and they adhered to an inner wall of the nozzle, and aggregation of the inclusions was promoted under too high concentrations of Ti and N. In this way, it was obvious that a mixed body consisting of the inclusions adhered on an inner wall of the nozzle and bare metal fell off by melted metal flow, were carried inside the mold, and were captured in solidified shells, and thereby, defects occurred in the alloy. Since this fallen off material is a mixed body of bare metal and inclusions, the specific weight is high, and it does not float in the mold. Therefore, it was also obvious that it caused severe surface defects. Furthermore, since CaO—$Al_2O_3$—MgO inclusions were present without being accompanied by TiN inclusions, they did not function as a forming core of TiN inclusion and they were harmless.

The present invention was completed by the abovementioned research, and the invention is an Fe—Cr—Ni alloy having superior surface properties having C≤0.05%, Si: 0.1 to 0.8%, Mn: 0.2 to 0.8%, P≤0.03%, S≤0.001%, Ni: 16 to 35%, Cr: 18 to 25%, Al: 0.2 to 0.4%, Ti: 0.25 to 0.4%, N≤0.016%, Mg: 0.0015 to 0.008%, Ca≤0.005%, O: 0.0002 to 0.005%, freely selected Mo: 0.5 to 2.5% in mass % and Fe and inevitable impurities as the remainder, wherein Ti and N satisfy % N×% Ti≤0.0045 and the number of TiN inclusions not smaller than 5 μm was 20 to 200 pieces/$cm^2$ in a freely selected cross section. Furthermore, it is desirable that the number of TiN inclusions not smaller than 10 μm be not more than 30 pieces/$cm^2$ at a freely selected cross section.

Furthermore, it is more desirable that the alloy contain CaO—MgO—$Al_2O_3$ as an oxide type inclusion as a necessary component, contain one or more kinds selected from MgO.$Al_2O_3$, MgO and CaO as a freely selected component, and that the ratio of numbers of MgO and CaO be not more than 50%.

It is desirable that compositions of the CaO—MgO—$Al_2O_3$ inclusions be CaO: 20 to 40%, MgO: 20 to 40% and $Al_2O_3$: 20 to 50% and compositions of the MgO.$Al_2O_3$ inclusion be MgO: 20 to 40% and $Al_2O_3$: 60 to 80%, and it is more desirable that compositions of the CaO—MgO—$Al_2O_3$ inclusions be CaO: 20 to less than 30%, MgO: more than 30 to 40% and $Al_2O_3$: 30 to 50%.

In the present invention, a method for production of the alloy is also provided. The method for production of the Fe—Cr—Ni alloy having superior surface properties includes steps of: melting raw materials in an electric furnace, decarburizing in AOD (Argon Oxygen Decarburization) and/or VOD (Vacuum Oxygen Decarburization), adding Si and Al, adding lime and fluorite so as to form CaO—$SiO_2$—MgO—$Al_2O_3$—F slag in order to perform Cr reduction, deoxidation and desulfuration, adding Ti, and forming into a slab by a continuous casting apparatus. It is desirable that compositions of the CaO—$SiO_2$—MgO—$Al_2O_3$—F slag be CaO: 50 to 70%, $SiO_2$: not more than 10%, MgO: 7 to 15%, $Al_2O_3$: 10 to 20% and F: 4 to 15%.

EFFECTS OF THE INVENTION

According to the present invention, by adjusting alloy components appropriately, oxide inclusions are controlled so that generation of TiN inclusions is restrained and prevents growth in size. As a result, in a product that is a thin plate, superior quality in which there are no surface defects can be obtained. By the present invention, material for a sheathed heater used for an electric cooker and an electric water heater can be provided with high yield and at low cost.

BEST MODE FOR CARRYING OUT THE INVENTION

First, reasons for limiting the chemical components in Fe—Cr—Ni alloy of the present invention are explained. It should be noted that "%" means "mass %" in the following explanation.

C: Not More than 0.05%

C is an element for stabilizing an austenite phase. Furthermore, since it also has an effect of increasing alloy strength by solid solution strengthening, it is a necessary element in order to maintain strength at normal temperatures and high temperatures. On the other hand, C is also an element that forms carbide with Cr having large effects of improving corrosion resistance, generates a Cr depletion layer therearound, and causes reducing corrosion resistance. Therefore, it is necessary that the upper limit of addition be 0.05%. It is desirably not more than 0.04%.

Si: 0.1 to 0.8%

Si is an important element in the present invention. It contributes to deoxidation and controls oxygen concentration to not more than 0.005%. Furthermore, it also plays a role in controlling Mg concentration to not more than 0.008% and Ca concentration to not more than 0.005% in an alloy. This is explained by the following reactions.

$$2(MgO)+Si=2Mg+(SiO_2) \quad (1)$$

$$2(CaO)+Si=2Ca+(SiO_2) \quad (2)$$

Here, the part in parentheses means the component in slag, and the underlined part means the component in melted alloy. In a case in which the Si concentration is less than 0.1%, oxygen concentration is higher than 0.005%. Furthermore, in a case in which Si is more than 0.8%, Mg concentration and Ca concentration are higher than 0.008% and 0.005%, respectively, at the same time, according to the above reactions (1) and (2). Therefore, the range is set as 0.1 to 0.8%. It is desirably 0.2 to 0.7%.

Mn: 0.2 to 0.8%

Since Mn is an element stabilizing an austenite phase, it is necessary to add at least 0.2%. However, since excess addition deteriorates oxidation resistance, the upper limit is set as 0.8%. Therefore, the range is set as 0.2 to 0.8%. It is desirably 0.2 to 0.7%.

P: Not More than 0.03%

Since P is a harmful element that segregates at grain boundaries and generates cracking during hot processing, and it is desirable to reduce it as much as possible. It is limited to not more than 0.03%.

S: Not More than 0.001%

Since S is a harmful element that segregates at grain boundaries, forms low-melting point compounds, and generates hot cracking during production, and it is desirable to reduce it as much as possible. It is limited to not more than 0.001%. It is desirably not more than 0.0008%.

Ni: 16 to 35%

Ni is an element stabilizing an austenite phase, and it is contained at not less than 16% from the viewpoint of structure stability. Furthermore, it also acts to improve heat resistance and strength at high temperatures. However, since excess addition causes increase in raw material cost, the upper limit is 35%. Therefore it is set as 16 to 35%. It is desirably 18 to 33%.

Cr: 18 to 25%

Cr is an effective element to improve corrosion resistance under wet conditions. Furthermore, it also has an effect of reducing decrease in corrosion resistance due to an oxide film which is formed by a heat treatment in which the atmosphere and dew point are not controlled like in an intermediate heat treatment. Furthermore, it is also effective for reducing corrosion under high temperature air conditions. It is necessary to add not less than 18% in order to stably maintain the effect of improving corrosion resistance under such wet conditions and high temperature air conditions. However, since excess amounts of added Cr actually reduce stability of an austenite phase and requires large addition of Ni, the upper limit is set as 25%. Therefore, it is set as 18 to 25%. It is desirably 19 to 23%.

Al: 0.2 to 0.4%

Al is an element required for properties necessary for a sheathed heater. That is, it is an effective element to form black film that is dense and has high emissivity, and it is necessary to contain at least 0.2%. Furthermore, it is an important element for deoxidation, it acts to control oxygen concentration to be not more than 0.005%, and it also acts to control oxide inclusions to CaO—MgO—$Al_2O_3$ and MgO.$Al_2O_3$. Furthermore, it also plays a role in controlling Mg concentration to not more than 0.008% and Ca concentration to not more than 0.005% in an alloy. This is explained by the following reactions.

$$3(MgO)+2Al=3Mg+(Al_2O_3) \quad (3)$$

$$3(CaO)+2Al=3Ca+(Al_2O_3) \quad (4)$$

In a case in which Al concentration is less than 0.2%, deoxidation is not promoted, and oxygen concentration is higher than 0.005%. Furthermore, since deoxidation is not promoted, S concentration is also higher than 0.001%. On the other hand, in a case in which it is higher than 0.4%, Mg concentration and Ca concentration are higher than 0.008% and 0.005%, respectively, at the same time, according to the above reactions (3) and (4). Therefore, the range is set as 0.2 to 0.4%. It is desirably 0.23 to 0.38%.

Ti: 0.25 to 0.4%

Ti is an element required for properties necessary for a sheathed heater. That is, it is an effective element to form black film that is dense and has high emissivity, and it is necessary to contain at least 0.25%. However, TiN inclusions are generated and surface defects occur in a case in which it is contained at more than 0.4%. TiN inclusions are inclusions that adhere on an inner wall of an immersed nozzle, and they are harmful. In a case in which the inclusions adhere in the immersed nozzle, formation of bare metal is also promoted, the adhered depositions having high specific weight fall off, are carried to the mold with melted alloy, are captured in a solidified shell, and cause surface defects. Therefore, it is set as 0.25 to 0.4%.

N: Not More than 0.016%

N acts effectively from the viewpoint of increasing proof stress of the alloy; however, it is also a harmful element since it forms TiN inclusions and surface defects may occur. TiN inclusions are inclusions that adhere on an inner wall of an immersed nozzle, and they are harmful. In a case in which the inclusion adheres in the immersed nozzle, formation of bare metal is also promoted, the adhered deposits having high specific weight fall off, are carried to the mold with melted alloy, are captured in a solidified shell, and cause surface defects. Furthermore, it adversely affects reducing effect of Ti that is solid-solved in a case in which TiN inclusions are formed. Therefore, the upper limit is set as 0.016%.

% Ti×% N≤0.0045

In the present invention, it is important to have the product of Ti concentration and N concentration be not more than 0.0045. In a case in which the product of Ti concentration and N concentration is more than 0.0045, TiN inclusions are formed at temperatures of melted alloy while passing through the immersed nozzle. Therefore, TiN inclusions adhere in the immersed nozzle, formation of bare metal is also promoted, the adhered deposits having high specific weight fall off, are carried to the mold with melted alloy, are captured in a solidified shell, and cause surface defects. Therefore, the product of Ti concentration and N concentration is set as not more than 0.0045. It is desirably not more than 0.004.

Mg: 0.0015 to 0.008%

Mg is an effective element to control so that oxide inclusions are CaO—$Al_2O_3$—MgO inclusions or MgO.$Al_2O_3$ inclusions, which do not contribute to forming cores of TiN inclusions. However, it is also a harmful element because it generates MgO inclusions that promote forming cores of TiN inclusions. Therefore, it is set to be not more than 0.008%. It is to be noted that it should be contained at not less than 0.0015%. The reason is that CaO—$Al_2O_3$—MgO inclusions can be maintained at an appropriate range of the present invention. Therefore, it is set as 0.0015 to 0.008%.

Ca: Not More than 0.005%

Ca is an effective element to control so that oxide inclusions are CaO—$Al_2O_3$—MgO inclusions that do not contribute to forming cores of TiN inclusions. However, it is also a harmful element because it generates CaO inclusions that promote formation of cores of TiN inclusions. Therefore, it is set as not more than 0.005%.

O: 0.0002 to 0.005%

Extreme decrease of O concentration promotes reactions (1) to (4) above, and Mg and Ca concentrations increase more than the upper limit of the present invention. As a result, MgO and CaO inclusions are generated and they promote formation of cores of TiN inclusions. From this viewpoint, not less than 0.0002% is necessary to be contained. However, in a case in which oxygen concentration is greater than 0.005%, S concentration is greater than 0.001% and hot workability is deteriorated. As a result, there may be a case in which surface defects remain on a cold-rolled plate. Therefore, oxygen concentration is set as 0.0002 to 0.005%. It is desirably 0.0003 to 0.003%.

Mo: 0.5 to 2.5%

The alloy of the present invention can contain Mo as a freely chosen component. Mo has an effect in which corrosion resistance under wet conditions with chlorides present and high temperature air conditions is greatly improved even by addition of small amounts, and in which the corrosion resistance is improved in proportion to amount of addition. On the other hand, in a material in which a large amount of Mo is added, Mo has adverse effects in which Mo is preferentially oxidized and an oxide film is exfoliated in a case in which surface oxygen potential is low and under high temperature air conditions. Therefore, Mo is set as 0.5 to 2.5%. It is desirably 0.58 to 2.45%, and more desirably 0.6 to 2.2%.

Next, the reason that the number of TiN inclusions of not less than 5 μm is limited 20 to 200 pieces/$cm^2$ at a freely selected cross section, is explained. When observing the relationship between tendency to generate surface defects and the number of TiN inclusions in a slab, a tendency was observed that thickness of deposited material on an inner wall of the nozzle that was more than 7 mm and surface defects occurred if the number is greater than 200 pieces/$cm^2$. At least under circumstances in which Ti and N are contained at 0.25% and 0.006%, respectively, TiN was confirmed to be at least 20 pieces/$cm^2$. Therefore, the number of TiN inclusions not less than 5 μm was set as 20 to 200 pieces/$cm^2$ at a freely selected cross section. It should be noted that the above TiN inclusions include a structure in which MgO or CaO inclusions exist at the center of a TiN inclusion.

The reason the number of TiN inclusions of not less than 10 μm is limited to not more than 30 pieces/$cm^2$ at a freely selected cross section, is explained. When observing the relationship between tendency to generate surface defects and the number of TiN inclusions of not less than 10 μm in a slab in addition to the above circumstances, a tendency was observed that when thickness of deposited material on an inner wall of the nozzle became greater than 9 mm, surface defects increased greatly if the number was greater than 30 pieces/$cm^2$. In particular, a long defect having a length of several meters occurred. Therefore, the number of TiN inclusions of not less than 10 μm is set to be not greater than 30 pieces/$cm^2$ at a freely selected cross section. It should be noted that the above TiN inclusion includes a structure in which MgO or CaO inclusions exists at the centers of TiN inclusions.

The reason that CaO—MgO—$Al_2O_3$ is contained as an oxide type inclusion as a necessary component, one or more kinds selected from MgO.$Al_2O_3$, MgO and CaO is contained as a freely selected component, and the ratio of numbers of MgO and CaO is not more than 50%, are explained. In the range of chemical components of the present invention, CaO—MgO—$Al_2O_3$ is necessarily contained, and one or more kinds selected from MgO.$Al_2O_3$, MgO and CaO are formed. First, CaO—MgO—$Al_2O_3$ inclusions and MgO.$Al_2O_3$ inclusions do not promote forming cores of TiN inclusions. On the other hand, MgO inclusions and CaO inclusions were confirmed to have the effect of promoting formation of cores of TiN inclusions. However, in a case in which the ratio of number of MgO inclusions and CaO inclusions is not greater than 50%, since formation sites of TiN inclusions are few, not many TiN inclusions are generated. Therefore, the present invention sets CaO—MgO—$Al_2O_3$ to be contained as an oxide type inclusion as a necessary component, one or more kinds selected from MgO.$Al_2O_3$, MgO and CaO to be contained as a freely selected component, and the ratio of numbers of MgO and CaO to be not more than 50%.

The reason that the compositions of the CaO—MgO—$Al_2O_3$ inclusions are CaO: 20 to 40%, MgO: 20 to 40% and $Al_2O_3$: 20 to 50%, is explained. Basically, in these ranges, CaO—MgO—$Al_2O_3$ inclusions are in melted condition, and this does not promote forming cores of TiN inclusions. Therefore, the lower limit of not less than 20% of CaO and MgO is for maintaining the melted condition. The upper limit of 40% of CaO and MgO is because CaO inclusions and MgO inclusions start to be generated if the content is greater than 40%. Regarding $Al_2O_3$, it can be maintained in melted condition within the range of 20 to 50%. It should be noted that in a case in which CaO and MgO are less than the lower limit of 20% and $Al_2O_3$ is higher than 50%, solid and liquid exist together, and they have the property of adhering on immersed nozzles. Therefore, the present invention sets CaO: 20 to 40%, MgO: 20 to 40% and $Al_2O_3$: 20 to 50%. They are desirably CaO: 20 to less than 30%, MgO: more than 30 to 40% and $Al_2O_3$: 30 to 50%.

Next, the reason that the compositions of the MgO.$Al_2O_3$ inclusion are MgO: 20 to 40% and $Al_2O_3$: 60 to 80%, is explained. MgO.$Al_2O_3$ inclusion is a compound in which Mg, Al and O are distributed uniformly. In order to form this compound, ranges of MgO: 20 to 40% and $Al_2O_3$: 60 to 80% are necessary. Therefore, it is set in this way.

A method for production is explained next. In order to produce the Fe—Cr—Ni alloy of the present invention, the following method for production is desirable as an embodiment. That is, raw materials such as Fe—Cr, Fe—Ni, stainless steel scrap, iron scrap and the like are melted in an electric furnace, and they are decarburized and refined by blowing oxygen in AOD (Argon Oxygen Decarburization) and/or VOD (Vacuum Oxygen Decarburization). CO gas is generated and decarburization is promoted during oxygen blowing, nitrogen in the melted alloy is also decreased then, and N can be controlled to within 0.006 to 0.016%. After that, Si and Al are added, lime and fluorite are added, and Cr reduction, deoxidation and desulfuration are performed by forming CaO—$SiO_2$—MgO—$Al_2O_3$—F slag. In order to add Si, Fe—Si alloy can be used. Here, $SiO_2$ is formed by addition of Si or silica contained in fluorite. MgO is added to the slag in an appropriate amount because a MgO type refractory brick (dolomite, MgO—Cr or MgO—C) is used as a refractory brick and it can be damaged and melted to slag. Alternatively, in order to prevent damage and melt the brick, it can be controlled by adding MgO type discarded brick. $Al_2O_3$ is formed by adding Al. F is formed by adding fluorite.

Ti is added after that, and temperature control and accurate control of Al and Ti are performed in a ladle. Finally, a slab is produced by a continuous casting apparatus. In this process, it is desirable that the temperature of an immersed nozzle for pouring the melted alloy from a tundish to a mold be maintained at 1430 to 1490° C. The reason is that many TiN inclusion are formed more as the temperature decreases at less than 1430° C. Furthermore, at more than 1490° C., the temperature of the melted alloy is too high and a solidified shell in the mold is not grown sufficiently.

Compositions of the CaO—$SiO_2$—MgO—$Al_2O_3$—F slag are desirably CaO: 50 to 70%, $SiO_2$: not more than 10%, MgO: 7 to 15%, $Al_2O_3$: 10 to 20% and F: 4 to 15%. The reason is explained as follows.

CaO: 50 to 70%

CaO is necessary to desulfurize and to control inclusion composition to CaO—MgO—$Al_2O_3$ inclusions. This is controlled by adding burnt lime. Desulfuration is not promoted at less than 50%, and S in the alloy is increased to more than 0.001%. On the other hand, formation of CaO inclusions and generation of TiN inclusions are promoted at more than 70%. Therefore, it is set as 50 to 70%.

$SiO_2$: Not More than 10%

$SiO_2$ is a necessary component in order to maintain melted condition of the slag; however, it acts as a component oxidizing the melted alloy, inhibits deoxidation and desulfuration, and increases Si concentration in the melted steel. Because it also has undesirable properties in this way, it is set as not more than 10%.

MgO: 7 to 15%

MgO is effective element to form CaO—MgO—$Al_2O_3$ inclusions and MgO.$Al_2O_3$ inclusions. However, excess addition causes formation of MgO inclusions and promoting formation of TiN inclusions. Therefore, it is set as 7 to 15%.

$Al_2O_3$: 10 to 20%

$Al_2O_3$ is an effective element to form CaO—MgO—$Al_2O_3$ inclusions and MgO.$Al_2O_3$ inclusions. However, excess addition causes too high viscosity of slag, and therefore slag removal cannot be performed. Therefore, it is set as 10 to 20%.

F: 4 to 15%

Since F acts to maintain slag in a melted condition during slag refining, it is necessary to add at least 4%. The slag will no longer melt and CaO and MgO become solid at less than 4%. That is, since solids of 100% CaO and 100% MgO exist, the reactions shown in (1) to (4) are promoted too much, Ca concentration and Mg concentration become too high, and TiN inclusion formation is promoted. On the other hand, viscosity is too low and flowability is too high at more than 15%. Therefore, the reactions shown in (1) to (4) are promoted too quickly, Ca concentration and Mg concentration are also high in this case, TiN inclusion formation is promoted. Therefore, it is set as 4 to 15%.

The surface of slab produced by the above method is then ground and hot-rolled by a known method. After that, annealing and acid pickling are performed so as to obtain a hot-rolled plate. Cold-rolling is performed after that so as to finally produce a cold-rolled plate. A surface defect of large size, which is a subject of the present invention, is present on the surface of the hot-rolled plate after hot-rolling.

Examples

The effects of the present invention are explained more clearly by way of Examples. First, raw material such as stainless steel scrap, iron scrap, nickel, ferronickel, ferrochromium and the like were melted in an electric furnace of 60 t. After that, decarburization was performed by oxygen blowing (oxidizing refining) in order to remove C in AOD and/or VOD. After that, Cr was reduced, and deoxidation was performed by forming $CaO—SiO_2—Al_2O_3—MgO—F$ slag by adding lime, fluorite, light-burnt dolomite, ferrosilicon alloy and Al. After that, desulfuration was performed by a further Ar stirring. It should be noted that dolomite bricks were lined in AOD and VOD. Next, temperature and chemical components were controlled in a ladle refining, and a slab was produced in a continuous casting apparatus. The surface of slab produced was ground and heated at 1200° C. to perform hot rolling. A hot coil having a plate thickness of 3 mm×width of 1 m×length of 500 in was produced.

Each evaluation method concerning a chemical component, slag composition, number of TiN inclusions, oxide inclusion composition, ratio or number of MgO and CaO, and surface defects of the hot rolled plate shown in Table 1 are as follows.

1) Chemical component of alloy and slag composition: Quantitative analysis was performed by X-ray fluorescence spectrometer. Quantitative analysis of oxygen concentration and nitrogen concentration of alloy was performed by the inert gas impulse melt infrared absorption method. It should be noted that the remainder of the alloy was Fe. Furthermore, the reason that the sum of compositions of the slag was not more than 100% was that inevitable impurities such as MgO, $Fe_2O_3$, S or the like were contained in the remainder.

2) Number of TiN inclusions: The slab having thickness of 200 mm produced by the continuous casting apparatus was cut in order to collect a test piece of 20 mm×20 mm from a location 10 mm beneath the surface. After mirror polishing of this test piece, the number of TiN inclusions was counted using an optical microscope.

3) Oxide inclusion composition: The abovementioned sample, which was used to count the number of TiN inclusions, was used for analysis. Using SEM-EDS, oxide inclusions having sizes not less than 5 μm were measured at 20 locations selected randomly. It should be noted that TiN inclusions and oxide inclusions can be distinguished from each other using an optical microscope since they have different shapes and color tones from each other, and to be sure, analysis of TiN was also performed.

4) Ratio of number of MgO and CaO: From the above measured result of (3), the ratio of numbers was calculated.

5) Evaluation of quality: The surface of the above hot-rolled plate produced by rolling was observed by the human eye, and the number of defects caused by TiN inclusions was counted. The evaluation was performed as follows. A "defect" here means a defect having a length not less than 200 mm along the rolling direction. The reason for this evaluation is that a defect smaller than 200 mm can be removed in cold rolling processing, which is a subsequent process.

A: No defects

B: Number of defects not more than 4

C: Number of defects not fewer than 5

TABLE 1

| | No. | Chemical component (mass %) Remainder Fe | | | | | | | |
|---|---|---|---|---|---|---|---|---|---|
| | | C | Si | Mn | P | S | Ni | Cr | Mo |
| Examples | 1 | 0.021 | 0.25 | 0.27 | 0.018 | 0.0002 | 30.42 | 20.12 | — |
| | 2 | 0.008 | 0.48 | 0.56 | 0.016 | 0.0003 | 29.98 | 21.32 | 0.1 |
| | 3 | 0.011 | 0.026 | 0.31 | 0.019 | 0.0003 | 32.02 | 19.56 | — |
| | 4 | 0.015 | 0.41 | 0.52 | 0.019 | 0.0007 | 25.02 | 23.48 | 1.25 |
| | 5 | 0.012 | 0.49 | 0.65 | 0.013 | 0.0001 | 19.35 | 21.53 | — |
| | 6 | 0.009 | 0.27 | 0.23 | 0.022 | 0.0005 | 33.56 | 23.54 | 0.1 |
| | 7 | 0.011 | 0.58 | 0.42 | 0.019 | 0.0005 | 18.35 | 20.12 | — |
| Comparative Examples | 8 | 0.007 | 0.25 | 0.29 | 0.018 | 0.0003 | 29.85 | 20.13 | — |
| | 9 | 0.012 | 0.61 | 0.41 | 0.02 | 0.0002 | 19.95 | 19.97 | — |
| | 10 | 0.009 | (0.07) | 0.41 | 0.022 | (0.0015) | 19.28 | 19.88 | 0.2 |
| | 11 | 0.019 | 0.24 | 0.32 | 0.019 | 0.0002 | 30.21 | 19.98 | — |
| | 12 | 0.012 | 0.24 | 0.33 | 0.018 | 0.0002 | 30.45 | 20.35 | 0.1 |
| | 13 | 0.009 | (1.05) | 0.45 | 0.017 | 0.0001 | 20.04 | 20.14 | — |
| | 14 | 0.022 | 0.24 | 0.35 | 0.018 | 0.0005 | 30.05 | 20.15 | — |

| | No. | Chemical component (mass %) Remainder Fe | | | | | | |
|---|---|---|---|---|---|---|---|---|
| | | Al | Ti | N | Mg | Ca | O | Ti × N |
| Examples | 1 | 0.32 | 0.38 | 0.009 | 0.0051 | 0.0012 | 0.0005 | 0.00342 |
| | 2 | 0.38 | 0.27 | 0.01 | 0.0075 | 0.0038 | 0.0005 | 0.0027 |

TABLE 1-continued

| | | | | | | | | |
|---|---|---|---|---|---|---|---|---|
| | 3 | 0.25 | 0.37 | 0.008 | 0.0025 | 0.0009 | 0.0008 | 0.00296 |
| | 4 | 0.28 | 0.31 | 0.014 | 0.0031 | 0.0011 | 0.0012 | 0.00434 |
| | 5 | 0.39 | 0.33 | 0.011 | 0.0072 | 0.0009 | 0.0005 | 0.00363 |
| | 6 | 0.28 | 0.28 | 0.016 | 0.0032 | 0.0014 | 0.0014 | 0.00448 |
| | 7 | 0.35 | 0.33 | 0.012 | 0.0078 | 0.0045 | 0.0008 | 0.00396 |
| Comparative Examples | 8 | 0.38 | 0.32 | (0.017) | 0.0055 | 0.0015 | 0.0006 | (0.00544) |
| | 9 | 0.35 | (0.43) | 0.012 | 0.0062 | 0.0021 | 0.0005 | (0.00516) |
| | 10 | (0.15) | 0.36 | 0.009 | (0.0014) | 0.0004 | (0.0055) | 0.00324 |
| | 11 | (0.42) | 0.36 | 0.01 | (0.0095) | 0.0035 | 0.0005 | 0.0036 |
| | 12 | (0.48) | 0.33 | 0.012 | (0.0085) | (0.0085) | (0.0001) | 0.00396 |
| | 13 | 0.38 | 0.33 | 0.012 | 0.0071 | (0.0065) | 0.0005 | 0.00396 |
| | 14 | (0.44) | 0.33 | (0.018) | (0.0115) | (0.00077) | 0.0005 | (0.00594) |

| | | Number of TiN (pieces/cm$^2$) | | | | | | | | | | |
|---|---|---|---|---|---|---|---|---|---|---|---|---|
| | | Not less than | Not less than | Siag composition (mass %) | | | | | CaO-MgO-$Al_2O_3$ | | | |
| | No. | 5 μ m | 10 μ m | CaO | $SiO_2$ | MgO | $Al_2O_3$ | F | n | CaO | MgO | $Al_2O_3$ |
| Examples | 1 | 75 | 12 | 64.4 | 2.8 | 8.5 | 13.3 | 9.8 | 10 | 28.2 | 36.3 | 35.5 |
| | 2 | 185 | 28 | 66.8 | 1.2 | 13.5 | 13.1 | 4.2 | 5 | 39.6 | 37.8 | 22.6 |
| | 3 | 23 | 1 | 62.3 | 4.2 | 7.6 | 16.8 | 8.5 | 17 | 22.8 | 32.1 | 45.1 |
| | 4 | 150 | 20 | 58.3 | 5.6 | 12.3 | 14.5 | 7.5 | 15 | 25.6 | 31.1 | 43.3 |
| | 5 | 146 | 25 | 61.6 | 2.8 | 13.2 | 12.3 | 9.8 | 3 | 20.6 | 35.8 | 43.6 |
| | 6 | 188 | 35 | 63.2 | 2.3 | 11.3 | 12.7 | 9.5 | 11 | 31.5 | 25.8 | 42.7 |
| | 7 | 190 | 32 | 62.1 | 3.2 | 9.5 | 15.2 | 9.2 | 1 | 23.5 | 30.2 | 48.3 |
| Comparative Examples | 8 | (289) | 40 | 64.2 | 3.4 | 8.3 | 12.3 | 8.5 | 12 | 30.1 | 33.5 | 36.4 |
| | 9 | (312) | 51 | 62.1 | 2.3 | 7.3 | 11.8 | 12.5 | 6 | 28.8 | 32.6 | 38.6 |
| | 10 | 76 | 2 | 48.3 | 23.6 | 8.3 | 12.5 | 5.3 | 18 | 17.5 | 16.3 | 66.2 |
| | 11 | (231) | 28 | 61.3 | 2.1 | 16.7 | 5.5 | 12.3 | 3 | 42.1 | 44.3 | 13.6 |
| | 12 | (289) | 38 | 63.8 | 2.9 | 13.3 | 12.5 | 3.2 | 0 | | | |
| | 13 | (256) | 42 | 71.3 | 11.5 | 4.6 | 1.3 | 10.1 | 0 | | | |
| | 14 | (425) | 55 | 61.3 | 3.2 | 7.3 | 11.2 | 16.8 | 0 | | | |

| | | Inclusion composition (mass %) Measured at 20 points by EDS | | | | | | | | |
|---|---|---|---|---|---|---|---|---|---|---|
| | | MgO·$Al_2O_3$ | | | MgO | | CaO | | Number ratio of | |
| | No. | n | MgO | $Al_2O_3$ | n | MgO | n | CaO | MgO and CaO (%) | Evaluation |
| Examples | 1 | 5 | 25.2 | 74.8 | 3 | 100 | 2 | 100 | 25 | A |
| | 2 | 6 | 30.2 | 69.8 | 5 | 100 | 4 | 100 | 45 | A |
| | 3 | 3 | 23.2 | 76.8 | 0 | | 0 | | 0 | A |
| | 4 | 2 | 25.3 | 74.7 | 2 | 100 | 1 | 100 | 15 | A |
| | 5 | 7 | 31.2 | 68.8 | 10 | 100 | 0 | | 50 | A |
| | 6 | 6 | 22.8 | 77.2 | 2 | 100 | 1 | 100 | 15 | B |
| | 7 | 8 | 23.5 | 76.5 | 6 | 100 | 5 | 100 | 55 | B |
| Comparative Examples | 8 | 3 | 23.5 | 76.5 | 2 | 100 | 3 | 100 | 25 | C |
| | 9 | 10 | 32.1 | 67.9 | 2 | 100 | 2 | 100 | 20 | C |
| | 10 | 2 | 22.8 | 77.2 | 0 | | 0 | | 0 | C |
| | 11 | 3 | 35.2 | 64.8 | 7 | 100 | 7 | 100 | 70 | C |
| | 12 | 3 | 32.9 | 67.1 | 9 | 100 | 8 | 100 | 85 | C |
| | 13 | 0 | | | 3 | 100 | 17 | 100 | 100 | C |
| | 14 | 0 | | | 13 | 100 | 7 | 100 | 100 | C |

Examples and Comparative Examples shown in Table 1 are explained. VOD was used as a refining furnace in Example 6, and combination of AOD and VOD was used in Example 7. AOD was used in refining in the other Examples and Comparative Examples.

In Examples 1 to 5, since the range of the present invention was satisfied, there were no defects generated. In Example 4, an alloy containing the desirable amount of Mo was produced.

In Example 6, since N concentration was high, being the upper limit of 0.016%, the product of Ti and N was high, 0.00448. Therefore, there were numerous, that is, 35, TiN inclusions of not less than 10 μm. As a result, three defects having lengths of 250 mm were observed. In Example 7, Mg concentration and Ca concentration were high, being respectively 0.0078% and 0.0045%, and ratio of numbers of MgO inclusions and CaO inclusions was 55%. Therefore, there were numerous, 32, TiN inclusions. As a result, one defect having a length of 400 mm was observed.

Next, Comparative Examples are explained.

In Comparative Example 8, since N concentration was 0.017% which was high, and the product of Ti and N was 0.00554, which was out of the range, the number of TiN inclusions not less than 5 μm and 10 μm was above the range, and there were many defects generated. In Comparative Example 9, Ti concentration was high and the product of Ti and N was 0.00516, which was more than the upper limit. As a result, the number of TiN inclusions not less than 5 μm and 10 μm was above the range, and there were many defects generated.

In Comparative Example 10, Si concentration and Al concentration were both lower than the lower limit, CaO concentration in the slag was low, and therefore, $SiO_2$ concentration was high. As a result, deoxidation was not promoted and oxygen concentration was 0.0055%, which was far out of the range, and in addition, desulfuration was also not promoted and sulfur concentration was 0.0015%, which was far out of the range. Furthermore, as a result, hot processing property was decreased, cracking occurred on the surface during hot rolling, and surface defects occurred. Furthermore, although CaO—MgO—$Al_2O_3$ inclusions were formed, Mg concentration and Ca concentration in melted alloy were relatively low, and as a result, MgO concentration and CaO concentration in inclusions were low, and $Al_2O_3$ concentration was above the upper limit. Therefore, the inclusion had a property in which solid and liquid coexisted, and it adhered to an inner wall of the immersed nozzle. Furthermore, the adhered material fell off and the surface defect caused by oxide inclusion also occurred.

In Comparative Example 11, since MgO concentration in the slag was high and Al concentration in the melted alloy was also high, Mg concentration was 0.0095%, which was high. Although CaO—MgO—$Al_2O_3$ inclusions formed, CaO concentration and MgO concentration were high and $Al_2O_3$ concentration was lower than the lower limit. At the same time, numerous MgO inclusions formed. As a result, the number of TiN inclusions not less than 5 μm was above the range, and there were many defects.

In Comparative Example 12, since F concentration in the slag was lower than the lower limit and Al concentration in the melted alloy was also high, O concentration was 0.0001%, which is low, Mg concentration and Ca concentration were respectively 0.0085% and 0.0061%, which were high, and numerous MgO inclusions and CaO inclusions were generated. In addition, CaO—MgO—$Al_2O_3$ inclusion was not formed. As a result, the number of TiN inclusions not less than 5 μm and 10 μm was above the range, and many defects occurred.

In Comparative Example 13, CaO concentration and $SiO_2$ concentration in the slag were high and Si concentration in the melted alloy was high. Therefore, Ca concentration was 0.0065%, which was high, and numerous CaO inclusions were formed. In addition, no CaO—MgO—$Al_2O_3$ inclusion was formed. As a result, the number of TiN inclusions not less than 5 μm and 10 μm was above the range, and numerous defects occurred.

In Comparative Example 14, F concentration in the slag was higher than the upper limit and Al concentration in the melted alloy was high. As a result, Mg concentration and Ca concentration were higher than the upper limit. Furthermore, N was 0.018%, which was high. Therefore, the product of Ti and N was 0.00594, which was high, and numerous MgO inclusions and CaO inclusions were formed. In addition, no CaO—MgO—$Al_2O_3$ inclusion was formed. As a result, numerous defects occurred.

According to the present invention, Fe—Cr—Ni alloys for sheathed heaters having high quality can be produced at low cost.

The invention claimed is:

1. Fe—Cr—Ni alloy comprising:

C<0.05%, Si: 0.1 to 0.8%, Mn: 0.2 to 0.8%, P<0.03%, S<0.001%, Ni:16 to 35%, Cr: 18 to 23%, Al: 0.2 to 0.4%, Ti: 0.25 to 0.4%, N<0.016%, Mg: 0.0015 to 0.008%, Ca<0.005%, 0: 0.0002 to 0.005% in mass %, and Fe and inevitable impurities as the remainder, wherein Ti and N satisfy % N×% Ti<0.0045 and the number of TiN inclusions not smaller than 5 μm is 20 to 200 pieces/$cm^2$ at a freely selected cross section, and the alloy contains CaO—MgO—$Al_2O_3$ as an oxide type inclusion as a necessary component, contains one or more kinds selected from MgO.$Al_2O_3$, MgO and CaO as a freely selected component, and a percentage of the total numbers of MgO and CaO inclusions with respect to total oxides (CaO—MgO—$Al_2O_3$, MgO.$Al_2O_3$, MgO and CaO) inclusions is not more than 50%.

2. The Fe—Cr—Ni alloy according to claim 1, wherein the number of TiN inclusions not smaller than 10 μm is not more than 30 pieces/$cm^2$ at a freely selected cross section.

3. The Fe—Cr—Ni alloy according to claim 1, wherein compositions of the CaO—MgO—$Al_2O_3$ inclusion are CaO: 20 to 40%, MgO: 20 to 40% and $Al_2O_3$: 20 to 50% and compositions of the MgO.$Al_2O_3$ inclusion are MgO: 20 to 40% and $Al_2O_3$: 60 to 80%.

4. The Fe—Cr—Ni alloy according to claim 3, wherein compositions of the CaO—MgO—$Al_2O_3$ inclusion are CaO: 20 to less than 30%, MgO: more than 30 to 40% and $Al_2O_3$: 30 to 50%.

5. The Fe—Cr—Ni alloy according to claim 1, wherein the alloy further comprises Mo: 0.5 to 2.5% in mass %.

6. A method for production of Fe—Cr—Ni alloy according to claim 1, comprising steps of:

melting raw materials in an electric furnace, decarburizing in AOD and/or VOD, adding Si and Al, adding lime and fluorite so as to form CaO—$SiO_2$—MgO—$Al_2O_3$—F slag in order to perform Cr reduction, deoxidation and desulfuration, adding Ti, and forming into a slab by a continuous casting apparatus.

7. The method for production of Fe—Cr—Ni alloy according to claim 6, wherein compositions of the CaO—$SiO_2$—MgO—$Al_2O_3$—F slag are CaO: 50 to 70%, $SiO_2$: not more than 10%, MgO: 7 to 15%, $Al_2O_3$: 10 to 20% and F: 4 to 15%.

* * * * *